US011825896B2

(12) United States Patent
Kozuki et al.

(10) Patent No.: US 11,825,896 B2
(45) Date of Patent: Nov. 28, 2023

(54) GLOVE WITH ANTI-SLIPPING FUNCTION

(71) Applicant: SHOWA GLOVE CO., Himeji (JP)

(72) Inventors: Kodai Kozuki, Himeji (JP); Kotaro Yoshimoto, Himeji (JP); Daisuke Kobayashi, Himeji (JP)

(73) Assignee: SHOWA GLOVE CO., Himeji (JP)

( * ) Notice: Subject to any disclaimer, the term of this patent is extended or adjusted under 35 U.S.C. 154(b) by 0 days.

(21) Appl. No.: 16/693,928

(22) Filed: Nov. 25, 2019

(65) Prior Publication Data

US 2020/0178626 A1 Jun. 11, 2020

(30) Foreign Application Priority Data

Dec. 5, 2018 (JP) ..... 2018-228271

(51) Int. Cl.
*A41D 19/015* (2006.01)
*A41D 19/00* (2006.01)

(52) U.S. Cl.
CPC .... *A41D 19/01558* (2013.01); *A41D 19/0065* (2013.01); *A41D 2400/80* (2013.01)

(58) Field of Classification Search
CPC ..... A41D 19/01558; A41D 19/00; A41D 19/015; A41D 19/0065; D06N 3/0009
USPC ..... 2/167, 161.8; 422/315
See application file for complete search history.

(56) References Cited

U.S. PATENT DOCUMENTS 2,120,722 A * 6/1938 Tillotson ..... B29D 99/0067 427/261
2,867,849 A * 1/1959 Drew et al. ..... B29C 41/14 264/233
4,519,098 A * 5/1985 Dunmire ..... A41D 19/015 2/161.8
5,815,840 A * 10/1998 Hamlin ..... A46B 5/04 2/161.6
6,016,570 A * 1/2000 Vande Pol ..... A41D 19/0058 2/161.7
6,993,793 B1 * 2/2006 Li ..... A41D 19/00 2/161.8
7,037,579 B2 * 5/2006 Hassan ..... B32B 25/02 428/295.1
8,387,167 B2 * 3/2013 Matsunobu ..... B29C 59/022 2/161.1

(Continued)

FOREIGN PATENT DOCUMENTS

JP 2004156178 A 6/2004
JP 2013104134 A 5/2013

(Continued)

OTHER PUBLICATIONS

Kang Young Choon, "Manufacturing Method of Gauntlet Glove and Gauntlet Glove by the Method" (translation), 2010, Clarivate Analytics (Year: 2010).*

(Continued)

*Primary Examiner* — Katherine M Moran
*Assistant Examiner* — Haley A Smith
(74) *Attorney, Agent, or Firm* — THE WEBB LAW FIRM

(57) ABSTRACT

A glove includes a glove body configured to cover a hand of a wearer. The glove body has an outermost layer including cellulose particles and constituting an outer surface of the glove. At least some of the cellulose particles are at least partially exposed from the outer surface.

4 Claims, 3 Drawing Sheets

(56) References Cited

U.S. PATENT DOCUMENTS

| | | | | |
|---|---|---|---|---|
| 8,709,573 | B2 * | 4/2014 | Hassan | B29C 41/22 427/407.1 |
| 8,938,814 | B2 * | 1/2015 | Tomono | A41D 19/01585 2/16 |
| 9,061,453 | B2 * | 6/2015 | Taylor | B32B 25/02 |
| 9,622,526 | B2 * | 4/2017 | Nakagawa | A41D 19/0082 |
| 2002/0013963 | A1 | 2/2002 | Nakamura et al. | |
| 2009/0139007 | A1 * | 6/2009 | Bevier | A41D 19/00 2/161.1 |
| 2010/0107304 | A1 * | 5/2010 | Matsunobu | B29C 59/02 2/167 |
| 2010/0325779 | A1 * | 12/2010 | Matsunobu et al. | A41D 19/00 2/167 |
| 2013/0305430 | A1 | 11/2013 | Tomono | |
| 2014/0115750 | A1 | 5/2014 | Kassam et al. | |
| 2015/0329755 | A1 * | 11/2015 | Hakoshima | C03C 17/3411 428/142 |
| 2017/0348065 | A1 * | 12/2017 | Bluecher | A41D 31/12 |
| 2020/0164610 | A1 * | 5/2020 | Davis | B32B 25/14 |
| 2021/0015188 | A1 * | 1/2021 | Kozuki | A41D 19/01558 |

FOREIGN PATENT DOCUMENTS

| | | | | |
|---|---|---|---|---|
| JP | WO2015022819 | A1 | * | 3/2017 |
| JP | 2018016898 | | * | 1/2018 |
| JP | 2018016898 | A | * | 2/2018 |
| JP | 2018016898 | A | | 2/2018 |
| KR | 20100132229 | A | * | 12/2010 |
| WO | 2013007983 | A1 | | 1/2013 |

OTHER PUBLICATIONS

Hemmati et al., "Synthesis and characterization of cellulose nanocrystals derived from walnut shell agricultural residues", International Journal of Biological Macromolecules, 2018, pp. 1216-1224, vol. 120.

* cited by examiner

GLOVE WITH ANTI-SLIPPING FUNCTION

CROSS-REFERENCE TO RELATED APPLICATION

This application claims priority to Japanese Patent Application No. 2018-228271 filed Dec. 5, 2018, the disclosure of which is hereby incorporated by reference in its entirety.

FIELD OF THE INVENTION

The present invention relates to a glove, and relates particularly to a glove used for grasping an object having a surface on which a film of hydrophilic liquid is formed.

BACKGROUND OF THE INVENTION

Conventionally, a glove having a slip-suppressing function is used to prevent or suppress an object from slipping on the outer surface of the glove when the wearer grasps the object.

For example, JP 2004-156178 A discloses a glove including a glove body configured to cover a hand of a wearer, in which anti-slipping particles are arranged on an outer surface of the glove body and the anti-slipping particles are synthetic resin particles such as acrylic particles, glass particles, or rubber articles. It further discloses that, according to such a glove, the anti-slipping particles arranged on the outer surface of the glove body prevent or suppress the object from slipping on the outer surface of the glove body and allow the object to be easily grasped by the wearer of the glove even in the case where the wearer handles an object with the wet surface, such as a dish during washing.

SUMMARY OF THE INVENTION

Technical Problem

However, the glove disclosed in JP 2004-156178 A has a problem that the slip-suppressing function is insufficient when the glove is used for grasping an object having a surface on which a film of hydrophilic liquid is formed. In particular, the problem is that, in the case where the object is an ice-containing object (which means ice itself or an object having the outer surface formed of ice), a film of water can be formed on the surface of the ice that is thawing, and thereby reduces the frictional resistance of the surface of the ice. Consequently, the ice-containing object is likely to slip on the outer surface of the glove body and is hardly grasped by the wearer.

In view of the aforementioned problem, it is an object of the present invention to provide a glove configured to allow the wearer of the glove to relatively easily grasp even an object having a surface on which a film of hydrophilic liquid is formed.

Solution to Problem

A glove according to the present invention includes: a glove body configured to cover a hand of a wearer, in which the glove body has an outermost layer including cellulose particles and constituting an outer surface of the glove, and at least some of the cellulose particles are at least partially exposed from the outer surface.

In the aforementioned glove, it is preferable that the cellulose particles have an average particle size of 10 μm or more and 45 μm or less.

In the aforementioned glove, it is preferable that the outermost layer include a resin and an additive other than the cellulose particles, and include 18 parts or more and 56 parts or less by mass of the cellulose particles based on 100 parts by mass of the total amount of the resin and the additive other than the cellulose particles.

BRIEF DESCRIPTION OF DRAWINGS

FIG. 1A is a view showing the overall configuration of the glove as seen from the back side, and FIG. 1B is a view showing the overall configuration of the glove as seen from the palm side.

FIG. 2A is a cross-sectional view of a glove body, and FIG. 2B is a cross-sectional view of a cuff.

FIG. 3A is a microscopic photo showing an enlarged view of an outer surface of the part of the slip-suppressing layer, and FIG. 3B is a microscopic photo showing an enlarged cross-sectional view of the part of the slip-suppressing layer.

DETAILED DESCRIPTION OF THE PREFERRED EMBODIMENT

Hereinafter, a glove according to one embodiment of the present invention will be described with reference to the drawings.

Figure 1A:
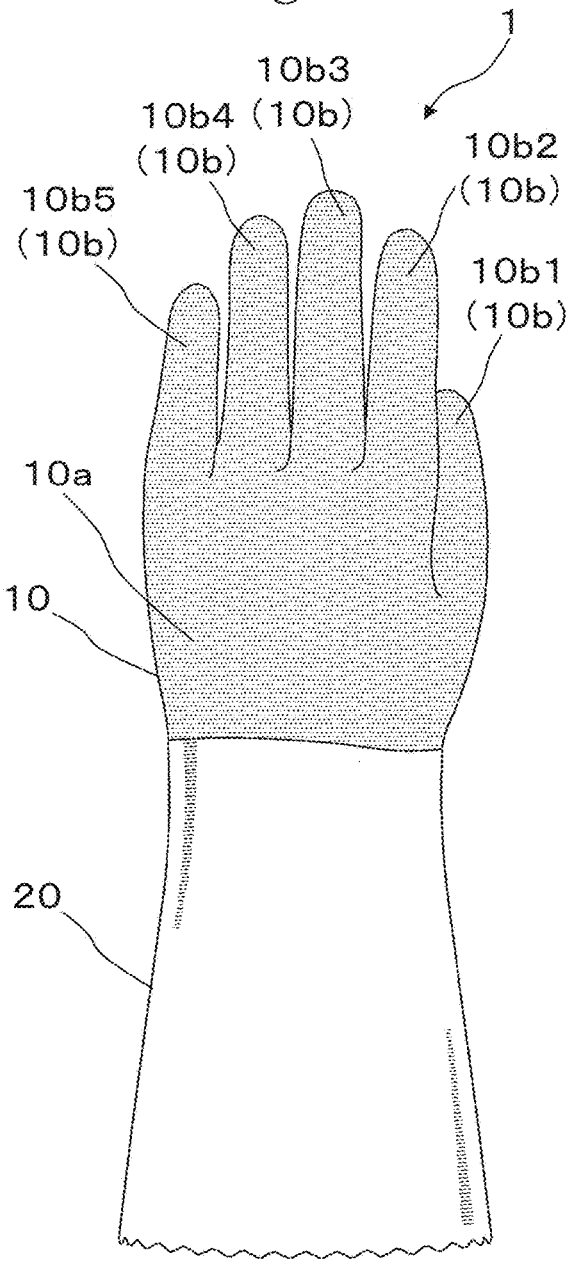
FIGS. 1A and 1B are views showing the overall configuration of a glove according to one embodiment of the present invention. Specifically.
Figure 1B:
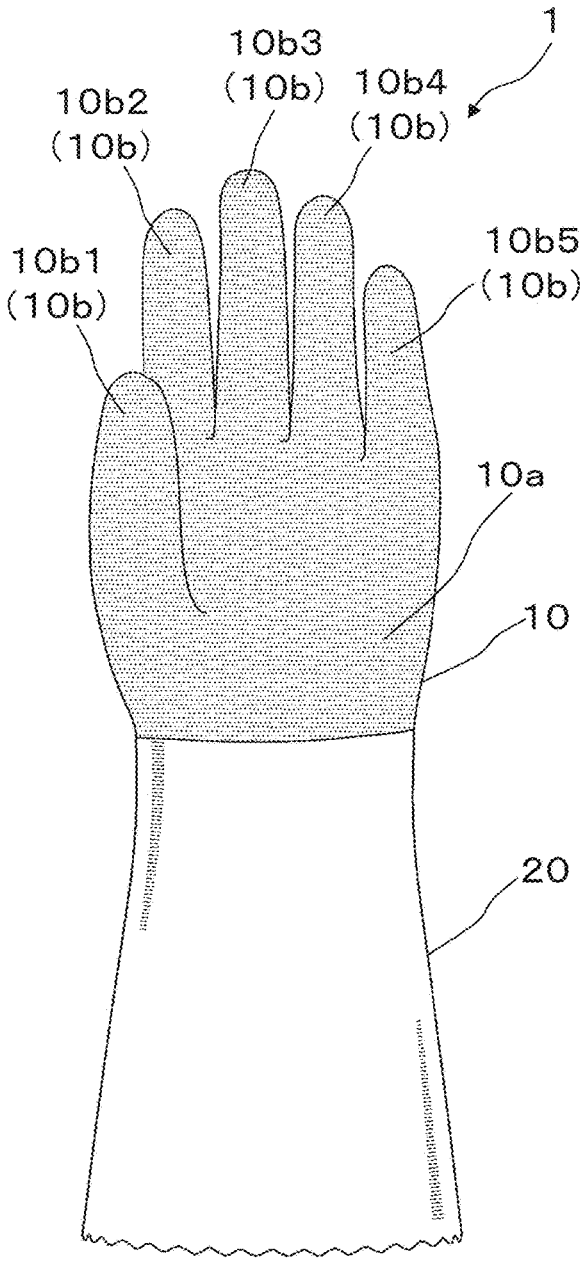

As shown in FIGS. 1A and 1B, a glove 1 according to this embodiment includes a glove body 10 configured to cover a hand of a wearer, and a cuff 20 connected to the glove body 10 and configured to cover a wrist and a part of a forearm of the wearer.

The glove body 10 includes a body bag 10*a* having a bag shape to cover the back and the palm of the hand of the wearer, and finger bags 10*b* each extending from the body bag 10*a* to cover each finger of the wearer. The finger bags 10*b* are constituted by a first finger part 10*b*1, a second finger part 10*b*2, a third finger part 10*b*3, a fourth finger part 10*b*4, and a fifth finger part 10*b*5 that respectively cover a first finger (a thumb), a second finger (an index finger), a third finger (a middle finger), a fourth finger (a ring finger), and a fifth finger (a little finger), of the wearer. The first finger part 10*b*1 to the fifth finger part 10*b*5 have a tubular shape with their fingertip parts closed.

Figure 2A:
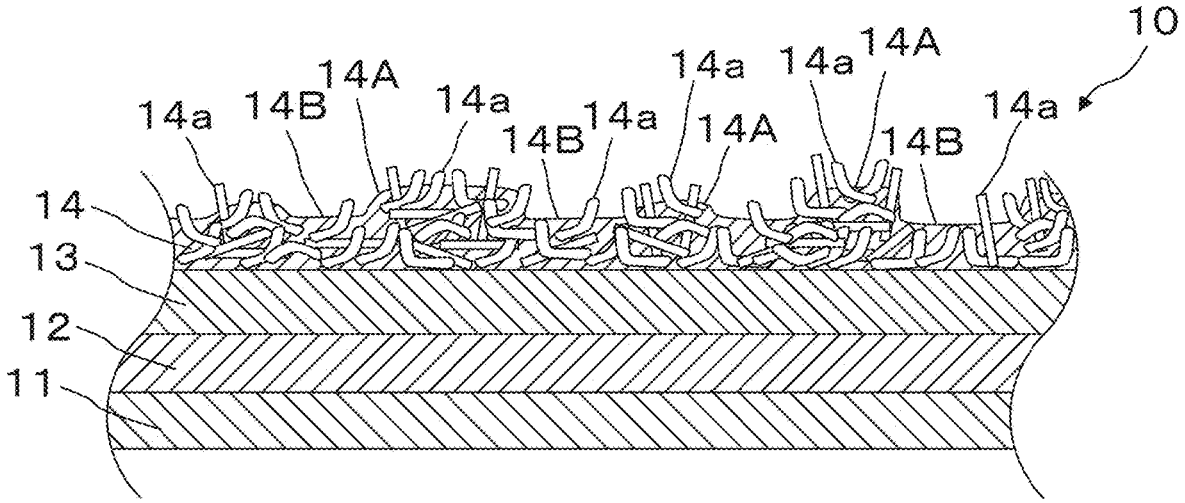
FIGS. 2A and 2B are cross-sectional views of the glove according to the one embodiment of the present invention. Specifically.

As shown in FIG. 2A, the glove body 10 has a four-layered structure. Specifically, the glove body 10 includes a fiber layer 11, a first resin layer 12 covering an outer surface of the fiber layer 11, a second resin layer 13 covering an outer surface of the first resin layer 12, and a slip-suppressing layer 14 covering an outer surface of the second resin layer 13. In the glove body 10, the fiber layer 11 is an innermost layer (i.e., a layer that comes in contact with the hand of the wearer of the glove 1) constituting the inner surface of the glove 1, and the slip-suppressing layer 14 is an outermost layer constituting the outer surface of the glove body 10.

The fiber layer 11 is formed by knitting a fiber material. Examples of the fiber material for use include a yarn made of any known general-purpose fiber (e.g., nylon fiber, polyester fiber, polyethylene fiber, cotton, acrylic fiber, rayon fiber), ultrahigh molecular weight polyethylene fiber, aramid fiber, glass fiber, or any known cut resistant fiber (e.g., stainless-steel fiber), and a composite yarn made of the various fibers above.

The fiber layer 11 is produced, for example, by knitting a fiber material into a glove shape using a glove knitting machine, or by knitting a fiber material using a circular knitting machine, a flat knitting machine, a warp knitting machine or the like, cutting the knitted fabric into a given shape, and sewing the cut fabric into a glove shape.

Generally, the thicker a glove is, the less flexible it becomes, which causes its wearer to be less likely to get the sense of touch at the moment when the wearer grasps the object. Thus, if a glove knitting machine is used, it is preferable to choose a 10 gauges or more and 26 gauges or less knitting machine, and for ease of knitting, choose a 13 gauges or more and 21 gauges or less knitting machine.

The fiber layer 11 is preferably formed to have a thickness of 0.1 mm or more and 1.5 mm or less.

The thickness of the fiber layer 11 is measured by a film thickness gauge (for example, PG-20 with a measuring force of 20 gf, manufactured by TECLOCK Co., Ltd.) before the first resin layer 12 is formed thereon. The thickness of the fiber layer 11 is obtained by arithmetically averaging the values measured at five given places using the film thickness gauge.

The fiber layer 11 may be, for example, subjected to various treatments using a softener, a water and oil repellant, an antimicrobial or the like, or have an ultraviolet blocking function imparted by applying an ultraviolet absorber to the fiber layer 11 or impregnating the fiber layer 11 with the ultraviolet absorber. In order to impart the various functions to the fiber layer 11, the fiber layer 11 may be formed by knitting a fiber material including the aforementioned various chemical agents (for example, a fiber material having the aforementioned various chemical agents kneaded therein).

The first resin layer 12 is formed to cover the entire area of the outer surface of the fiber layer 11.

Examples of a resin constituting the first resin layer 12 include various known resins such as vinyl chloride resin, natural rubber, nitrile butadiene rubber, chloroprene rubber, fluororubber, silicone rubber, isoprene rubber, polyurethane, acrylic resin, or their modified products (e.g., a carboxyl-modified product). Alternatively, these various known resins are used in combination.

The various known resins may be mixed with: a generally used vulcanizing agent such as sulfur; a vulcanization accelerator such as zinc dimethylthiocarbamate; a vulcanization accelerator such as zinc oxide; a cross-linking agent such as a blocked isocyanate; a plasticizer or a softener such as a mineral oil or a phthalate ester; an antioxidant or an aging inhibitor such as 2,6-di-t-butyl-4-methylphenol; a thickener such as an acrylic polymer or a polysaccharide; a blowing agent such as azocarbonamide; a foaming agent or a foam stabilizer such as sodium stearate; an additive such as an anti-tacking agent, e.g., a paraffin wax; and a filler such as carbon black, calcium carbonate, or fine powder silica.

The first resin layer 12 is preferably formed to have a thickness of 0.05 mm or more and 1.5 mm or less.

The thickness of the first resin layer 12 is measured by observing its cross section at a magnification of 200 times using a digital microscope (model VHX-6000, manufactured by KEYENCE CORPORATION), and then arithmetically averaging the values measured at 10 places at intervals of 500 μm. The cross-sectional observation using the digital microscope is carried out by observing a cross section of the center of a palm of the glove.

The center of the palm of the glove herein means an area in the palm near the point at which a straight line drawn in a longitudinal direction of the glove (i.e., a direction in which the third finger part **10*b*3 extends) from the crotch between the third finger part 10*b*3 and the fourth finger part 10*b*4 intersects with a straight line drawn in a lateral direction of the glove (i.e., a direction orthogonal to the longitudinal direction) from the crotch between the first finger part 10*b*1 and the second finger part 10*b*2**.

The first resin layer 12 is preferably formed as a non-porous resin layer. The first resin layer 12 thereby increases its strength. The non-porous resin layer herein means a layer having no visible voids when the cross-section thereof is observed at a magnification of 100 times using a digital microscope (model VHX-6000, manufactured by KEYENCE CORPORATION). However, any void resulting from unexpected foam or bubbles shall be ignored.

It is preferable that the first resin layer 12 penetrate partially into voids among fibers of the fiber layer 11, in terms of allowing the voids among fibers of the fiber layer 11 to hold air and in terms of increasing adhesiveness to the fiber layer 11.

The second resin layer 13 is formed of the same resin as that of the first resin layer 12. The second resin layer 13 is formed to cover the entire area of the outer surface of the first resin layer 12. The second resin layer 13 is formed to increase the thickness of the resin layer. As in the case of the first resin layer 12, the second resin layer 13 is also preferably formed as a non-porous resin layer.

The second resin layer 13 may be formed of the same resin as that of the first resin layer 12, or may be formed of a different resin from that of the first resin layer 12. In the case where the second resin layer 13 is formed of a different resin from that of the first resin layer 12, an adhesive layer may be provided between the first resin layer 12 and the second resin layer 13 to increase adhesiveness therebetween. The adhesive layer can be formed of any known adhesive such as an acrylic-based or urethane-based adhesive. The adhesive used preferably has a solubility parameter (SP value) that falls between the SP value of the material of the first resin layer 12 and the SP value of the material of the second resin layer 13.

The second resin layer 13 is generally formed to have a thickness of 0.01 mm or more and 1.0 mm or less.

The thickness of the second resin layer 13 is measured in the same manner as the thickness of the first resin layer 12.

The slip-suppressing layer 14 is formed to cover the outer surface of the second resin layer 13. The slip-suppressing layer 14 is the outermost layer constituting the outer surface of the glove 1. The slip-suppressing layer 14 is generally formed to have a thickness of 0.01 mm or more and 0.1 mm or less. The slip-suppressing layer 14 is preferably formed to have a thickness of 0.02 mm or more and 0.07 mm or less.

The thickness of the slip-suppressing layer 14 is measured by observing its cross section at a magnification of 200 times using a digital microscope (model VHX-6000, manufactured by KEYENCE CORPORATION), and then arithmetically averaging the values measured at any 50 places.

The slip-suppressing layer 14 may be formed on the entire area of the outer surface of the second resin layer 13, but may be formed only on part of the outer surface of the second resin layer 13, that is, only on an area that can come into contact with an object having a surface on which a film of hydrophilic liquid is formed, when the wearer grasps such an object. For example, the slip-suppressing layer 14 may be formed only on the palm side of the glove body 10, or may be formed only on the fingertip parts on the palm side. The slip-suppressing layer 14 is configured to suppress an object having a surface on which a film of hydrophilic liquid is formed, particularly an ice-containing object, from slipping on the outer surface of the glove body 10 due to the film of water formed on the surface of the ice when the wearer of the glove 1 grasps such an ice-containing object. Specifically, the slip-suppressing layer 14 includes a resin and cellulose particles 14*a*. The slip-suppressing layer 14 may include an additive other than the cellulose particles 14*a*. Examples of the additive other than the cellulose particles 14*a* include a plasticizer, a pH adjuster, a vulcanizing agent, a metal oxide, a vulcanization accelerator, an aging inhibitor, an inorganic filler, a defoaming agent, a thickener, and a pigment.

The hydrophilic liquid herein means a liquid that homogenously mixes with water at a given ratio at normal temperature (for example, 25° C.). Examples of the hydrophilic liquid include water, methanol, ethanol, n-propyl alcohol, isopropyl alcohol, and acetone.

The resin included in the slip-suppressing layer 14 can be the same resin as that constituting the first resin layer 12.

The cellulose particles 14*a* included in the slip-suppressing layer 14 can be any known various cellulose particles, regenerated cellulose particles, or the like. The cellulose particles 14*a* are preferably particles of ground natural wood cellulose (hereinafter referred to as ground cellulose particles). Since such ground cellulose particles typically have different shapes from one another, a relatively high proportion of particles have surfaces and angular portions that come into contact with an object. The ground cellulose particles can thereby have relatively large portions that come into contact with an object having a surface on which a film of hydrophilic liquid is formed. Thus, use of the ground cellulose particles as the cellulose particles 14*a* included in the slip-suppressing layer 14 improves the slip-suppressing function at the moment of grasping the object. As the cellulose particles 14*a*, KC FLOCK (registered trademark), for example, can be used. As KC FLOCK, KC FLOCK W-100GK (manufactured by Nippon Paper Industries Co., Ltd.), for example, can be used.

The cellulose particles 14*a* are preferably fibrous particles. The fibrous particles are the particles having a ratio L/D being 2.0 or more, more preferably 2.5 or more, still more preferably 3.0 or more, where D represents the width of each particle and L represents the length of the particle. In the case where the cellulose particles 14*a* are fibrous particles, the length L is preferably 5 μm or more and 100 μm or less, more preferably 10 μm or more and 95 μm or less, while the width D is preferably 1 μm or more and 25 μm or less, more preferably 3 μm or more and 20 μm or less. The width of the particle means a length in the short side direction of each fibrous particle. In the case where the length in the short side direction varies according to the measurement position, the largest value is regarded as the width of the particle. The length of the particle means a length in the longitudinal direction of each fibrous particle. In the case where the fibrous particle has a linear shape, the length of the particle means the length from an end of the linear shape to the other end thereof. In the case where the fibrous particle has a curled shape (for example, a crimped shape) or a bent shape (for example, an L-shape or a V-shape), the length of the particle means the length of the line segment connecting an end of the particle and the other end thereof in the curled or bent state.

The width D of the particle and the length L of the particle can be obtained by measuring L and D of any 10 particles while observing the particles before being mixed with the resin or the like at a magnification of 500 or 1000 times using a digital microscope (model VHX-6000, manufactured by KEYENCE CORPORATION), and then arithmetically averaging the measured values of L and D, respectively.

The cellulose particles 14*a* have a relatively high water absorption rate since cellulose includes a large number of hydroxyl groups. The relatively high water absorption rate herein means that the saturated water absorption rate is 7% or more in an environment at 25° C. and at 65% relative humidity.

Figure 3A:
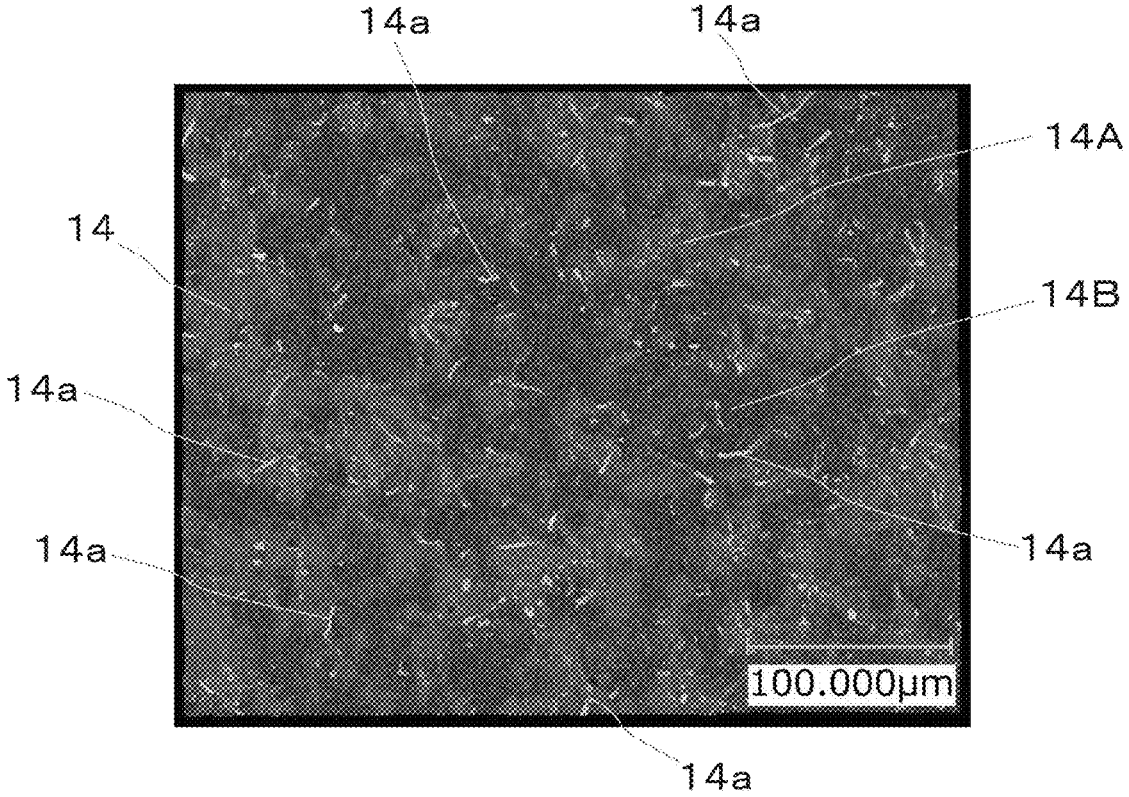
FIGS. 3A and 3B are microscopic photos showing enlarged views of a part of a slip-suppressing layer of the glove according to the one embodiment of the present invention. Specifically.
Figure 3B:
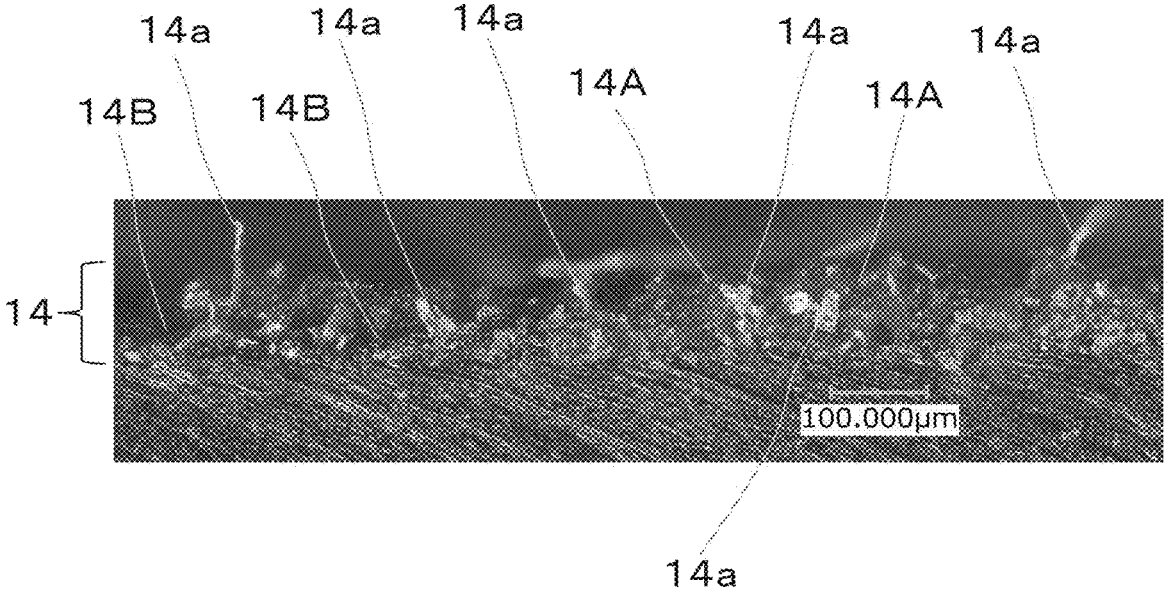

As shown in FIG. 2A, FIG. 3A, and FIG. 3B, the slip-suppressing layer 14 includes the cellulose particles 14*a*. At least some of the cellulose particles 14*a* are at least partially exposed from the outer surface of the slip-suppressing layer 14. In FIG. 3A and FIG. 3B, the cellulose particles 14*a* are shown in white. The cellulose particles 14*a* that are at least partially exposed from the outer surface of the slip-suppressing layer 14 suppress an object having a surface on which a film of hydrophilic liquid is formed, particularly an ice-containing object, from slipping on the outer surface of the glove body 10 caused by the film of water formed on the surface of the ice when the wearer of the glove 1 grasps such an ice-containing object. This enables the wearer of the glove 1 to easily grasp the ice-containing object. The part of the cellulose particles 14*a* that is not exposed from the outer surface of the slip-suppressing layer 14 is embedded in the slip-suppressing layer 14 and secured therein; therefore, the cellulose particles 14*a* can be suppressed from excessively falling from the slip-suppressing layer 14 when the wearer of the glove 1 grasps the ice-containing object.

As shown in FIG. 2A, FIG. 3A, and FIG. 3B, the slip-suppressing layer 14 includes, on its outer surface, projections 14A each formed by a plurality of cellulose particles 14*a* that gather in the slip-suppressing layer 14 and rise outward from the outer surface of the slip-suppressing layer 14, and recesses 14B that are recessed more toward the second resin layer 13 than the projections 14A. That is, the slip-suppressing layer 14 has an uneven outer surface. The projections 14A are randomly arranged on the outer surface of the slip-suppressing layer 14. The projections 14A and the recesses 14B in the slip-suppressing layer 14 are determined using a digital microscope (model VHX-6000, manufactured by KEYENCE CORPORATION). Specifically, the cross-sectional shape (measurement curve) of the slip-suppressing layer 14 is displayed on the monitor using the dedicated software under the conditions in which the line roughness mode is selected as the measurement mode, "roughness" is selected as the measurement type, the reference length is set to 1 mm, and no cutoff is made. In a portion of the measurement curve corresponding to the reference length, a portion projecting more toward the upper side of the monitor than the average line of the measurement curve is determined as a projection 14A while a portion recessed more toward the lower side of the monitor than the average line is determined as a recess 14B. The slip-suppressing layer 14 including the projections 14A and the recesses 14B can exhibit a more sufficient slip-suppressing function for an object having a surface on which a film of hydrophilic liquid is formed when the object is grasped. As aforementioned, the glove 1 according to this embodiment includes the cellulose particles 14*a* exposed from the outer surface of the slip-suppressing layer 14, and further includes the projections 14A and the recesses 14B on the outer surface of the slip-suppressing layer 14; thus, it can exhibit an excellent slip-suppressing function when the wearer of the glove 1 grasps an object having a surface on which a film of hydrophilic liquid is formed.

The occupancy ratio of the projections 14A on the outer surface of the slip-suppressing layer 14 (hereinafter referred to simply as the occupancy ratio of the projections 14A) is preferably 10% or more and 60% or less, more preferably 30% or more and 60% or less, still more preferably 35% or more and 60% or less. The occupancy ratio of the projections 14A is measured using a digital microscope (model VHX-6000, manufactured by KEYENCE CORPORATION). Specifically, the length of a segment of the average line of the cross-sectional shape (measurement curve) that intersects with a portion of the measurement curve constituting a projection 14A (hereinafter referred to as the intersecting line segment) is obtained within the reference length of the measurement curve of the slip-suppressing layer 14 (or in the case where a plurality of projections 14A are included within the reference length, the total length of the intersecting line segments respectively corresponding to the portions of the measurement curve constituting the plurality of projections 14A is obtained) to calculate the ratio of the length of the intersecting line segment(s) to the reference length. In the case where a portion of the measurement curve constituting a projection 14A is partially included within the reference length, the length of a portion of the intersecting line segment thereof that is included within the reference length is obtained.

Although it is uncertain how the glove 1 according to this embodiment suppresses slipping of the ice-containing object when grasped, the present inventors assume the reason for the slip suppression as follows. As described above, cellulose in the cellulose particles 14*a* includes a large number of hydroxyl groups, and is thereby assumed to achieve relatively high affinity between the exposed sides of the cellulose particles 14*a* and the surface of ice. Accordingly, the portion in which the surface of ice comes in contact with the exposed sides of the cellulose particles 14*a* has a relatively high frictional resistance. The ice-containing object is thus suppressed from slipping on the outer surface of the glove 1.

In particular, in the case where the cellulose particles 14*a* are fibrous particles, such cellulose particles 14*a* each having a long narrow shape can efficiently scratch into the film of water on the surface of ice. Thus, the exposed sides of the cellulose particles 14*a* easily come into contact with the surface of ice. The cellulose particles 14*a* each having a fibrous shape easily follow the motion of the ice-containing object. As a result, the portion in which the surface of ice comes in contact with the exposed sides of the cellulose particles 14*a* has a relatively high frictional resistance. This allows the ice-containing object to be suppressed from slipping on the outer surface of the glove 1.

The average particle size of the cellulose particles 14*a* is preferably 10 μm or more and 45 μm or less, more preferably 17 μm or more and 45 μm or less. The cellulose particles 14*a* with the average particle size falling within the aforementioned numerical range can more sufficiently suppress an object having a surface on which a film of hydrophilic liquid is formed, in particular an ice-containing object, from slipping on the outer surface of the glove body 10 due to the film of water formed on the surface of ice. Further, the cellulose particles 14*a* having such an average particle size can be more sufficiently suppressed from excessively falling from the slip-suppressing layer 14 when the wearer of the glove 1 grasps the ice-containing object. Such cellulose particles 14*a* can exhibit the sufficient slip-suppressing effect also for an object having a surface on which a film of hydrophilic liquid is not formed.

The average particle size of the cellulose particles 14*a* is measured before they are mixed, using a laser diffraction-type particle-size-distribution measuring apparatus (Mastersizer 2000 manufactured by Malvern Panalytical Ltd) as a measuring device. Specifically, the measurement is performed using the dedicated software called Mastersizer 2000 Software in which the scattering type measurement mode is employed. A wet cell through which dispersion liquid with a measurement sample (cellulose particles) dispersed therein is circulated is irradiated with a laser beam to obtain a scattered light distribution from the measurement sample. Then, the scattered light distribution is approximated according to a log-normal distribution, and a particle size corresponding to the cumulative frequency of 50% (D50) within the preset range from the minimum value of 0.021 μm to the maximum value of 2000 μm in the obtained particle size distribution (horizontal axis, σ) is determined as the average particle size. The dispersion liquid for use is prepared by adding 60 mL of 0.5 mass % hexametaphosphoric acid solution to 350 mL of purified water. The concentration of the measurement sample in the dispersion liquid is 10%. Before the measurement, the dispersion liquid including the measurement sample is processed for two minutes using an ultrasonic homogenizer. The measurement is performed while the dispersion liquid including the measurement sample is agitated at an agitating speed of 1500 rpm.

Short fibers (such as pile) used for being implanted in the inner surface of a glove have a length of, for example, 300 μm or more and 800 μm or less, which are significantly longer than the cellulose particles 14*a* having the average particle size of, as aforementioned, 10 μm or more and 45 μm or less (hereinafter referred to simply as the aforementioned cellulose particles 14*a*).

Thus, in the case where the short fibers in the same number as that of the aforementioned cellulose particles 14*a* are included in the slip-suppressing layer 14 having the same thickness as aforementioned, the longer the short fibers are as compared with the average particle size of the aforementioned cellulose particles 14*a*, the more densely the short fibers should be included in the slip-suppressing layer 14. Further, the more densely the short fibers are included in the slip-suppressing layer 14, the harder the slip-suppressing layer 14 with the short fibers included therein should be as compared with the slip-suppressing layer 14 with the aforementioned cellulose particles 14*a* included therein.

The slip-suppressing layer 14 including the short fibers has a higher proportion of short fibers exposed from the slip-suppressing layer 14 than that of the slip-suppressing layer 14 including the aforementioned cellulose particles 14*a*, and thus becomes less likely to exhibit the slip-suppressing effect for an object having a surface on which a film of hydrophilic liquid is not formed. Further, such a slip-suppressing layer 14 having a high proportion of short fibers exposed therefrom becomes less resistant to abrasion.

The longer the short fibers are as compared with the average particle size of the aforementioned cellulose particles 14*a*, the more likely the short fibers are to agglutinate in mixing materials (a third coating liquid to be described later) as compared with the aforementioned cellulose particles 14*a*. Thus, the mixing materials including the short fibers become more likely to be destabilized than the mixing materials including the aforementioned cellulose particles 14*a*.

A possible way of suppressing the short fibers as aforementioned from being densely included in the slip-suppressing layer 14 may be to reduce the number of short fibers included therein. In such a case, however, the fewer the short fibers are included in the slip-suppressing layer 14, the fewer the short fibers are exposed from the surface of the slip-suppressing layer 14. As a result, the slip-suppressing layer 14 should decrease its slip-suppressing function for an object having a surface on which a film of hydrophilic liquid is formed.

Another possible way of suppressing the short fibers from being densely included in the slip-suppressing layer 14 may be to increase the thickness of the slip-suppressing layer 14. However, the thicker the slip-suppressing layer 14 is, the harder it could be, depending on the type of resin included in the slip-suppressing layer 14.

In contrast, the aforementioned cellulose particles 14*a* are significantly shorter than the short fibers, and thus less likely to cause the problems concerned as aforementioned when included in the slip-suppressing layer 14. Thus, the aforementioned cellulose particles 14*a* included in the slip-suppressing layer 14 enable the slip-suppressing layer 14 to exhibit a more sufficient slip-suppressing function while, in particular, sufficiently suppressing the slip-suppressing layer 14 from being hardened.

In the case where the slip-suppressing layer 14 includes an additive other than the cellulose particles 14*a*, it preferably includes 18 parts or more and 56 parts or less by mass of the cellulose particles 14*a* based on 100 parts by mass of the total amount of resin and the additive other than the cellulose particles 14*a*. The cellulose particles 14*a* included in the slip-suppressing layer 14 within the aforementioned range can more sufficiently suppress an object having a surface on which a film of hydrophilic liquid is formed, in particular an ice-containing object, from slipping on the outer surface of the glove body 10 due to the film of water formed on the surface of the ice-containing object. Further, since 18 parts or more and 56 parts or less by mass of the cellulose particles 14*a* are included based on 100 parts by mass of the total amount of the resin and the additive other than the cellulose particles 14*a*, the cellulose particles 14*a* can be more sufficiently suppressed from excessively falling from the slip-suppressing layer 14 when the wearer of the glove 1 grasps the ice-containing object.

Figure 2B:
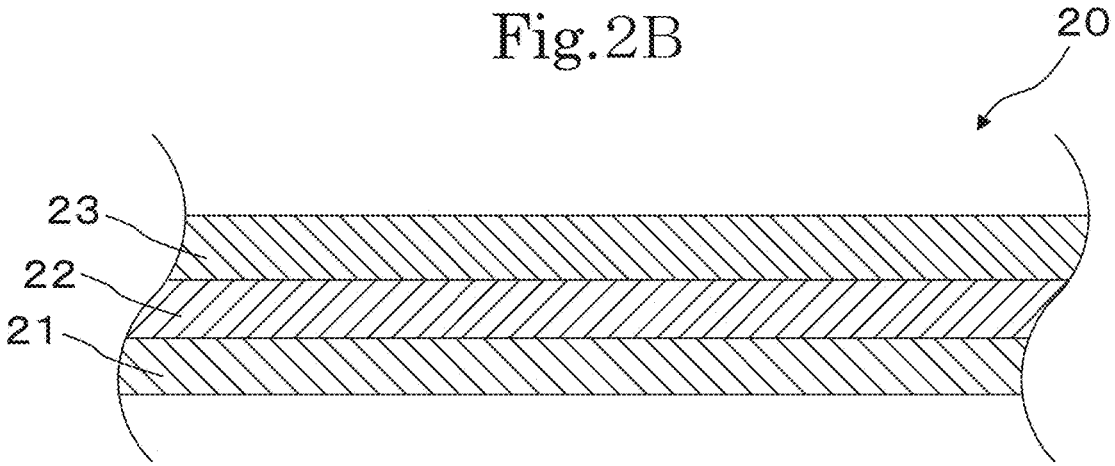

The cuff 20 is formed in a tubular shape. As shown in FIG. 2B, the cuff 20 has a three-layered structure. Specifically, the cuff 20 includes a fiber layer 21, a first resin layer 22 covering the outer surface of the fiber layer 21, and a second resin layer 23 covering the outer surface of the first resin layer 22. In the cuff 20, the fiber layer 21 is an innermost layer while the second resin layer 23 is an outermost layer. That is, the cuff 20 has a different layered structure from that of the glove body 10 in that it has the second resin layer 23 as the outermost layer.

In the glove 1 according to this embodiment, the cuff 20 is formed continuously and integrally with the glove body 10. That is, in the glove 1, the two fiber layers (i.e., the fiber layer 11 and the fiber layer 21), the two first resin layers (i.e., the first resin layer 12 and the first resin layer 22), and the two second resin layers (i.e., the second resin layer 13 and the second resin layer 23) are respectively formed continuously and integrally with each other; thus, the fiber layer 21 has the same configuration as the fiber layer 11, the first resin layer 22 has the same configuration as the first resin layer 12, and the second resin layer 23 has the same configuration as the second resin layer 13. Thus, no explanation will be given on the configurations of the fiber layer 21, the first resin layer 22, and the second resin layer 23.

The glove 1 configured as above can be produced according to, for example, the following steps.

First, a fiber glove including the glove body 10 and the cuff 20 (i.e., a fiber glove including the fiber layers 11 and 21) is produced using a glove knitting machine.

Next, the fiber glove is put on a hand form, and a first coating liquid including a resin to form the first resin layers 12 and 22 covering the entire areas of the outer surface of the fiber glove (i.e., the entire area of the outer surfaces of the fiber layers 11 and 21) is applied to the entire area of the outer surface of the fiber glove. The first coating liquid is applied to the entire area of the outer surface of the fiber glove by, for example, immersing the fiber glove put on the hand form in the first coating liquid. The hand form is any known hand form made of ceramic, metal, or the like. After having the first coating liquid applied thereto, the fiber glove put on the hand form is dried at a certain temperature over a certain period of time by, for example, being placed in an oven for drying at 80° C. for 60 minutes, to form the first resin layers 12 and 22 on the entire area of the outer surface of the fiber glove.

Before the first coating liquid is applied, the fiber glove put on the hand form may be entirely immersed in a coagulant solution to pretreat the outer surface of the fiber glove. Examples of the coagulant solution include a solution prepared by dissolving 1-5 parts by mass of calcium nitrate in 100 parts by mass of methanol.

As the resin of the first coating liquid, any known resin as aforementioned can be used. In addition to the resin, the first coating liquid may include various additives such as a pH adjuster, a vulcanizing agent, a metal oxide, a vulcanization accelerator, an aging inhibitor, an inorganic filler, a defoaming agent, a thickener, and a pigment. For the pH adjuster, 0.2 part or more and 0.7 part or less by mass thereof is preferably included based on 100 parts by mass of the total amount of the resin and the aforementioned various additives. Examples of the pH adjuster include potassium hydroxide. For the vulcanizing agent, 0.1 part or more and 2.0 parts or less by mass thereof is preferably included based on 100 parts by mass of the total amount of the resin and the aforementioned various additives. Examples of the vulcanizing agent include sulfur. For the metal oxide, 1.0 part or more and 4.0 parts or less by mass thereof is preferably included based on 100 parts by mass of the total amount of the resin and the aforementioned various additives. Examples of the metal oxide include zinc oxide. For the vulcanization accelerator, 0.1 part or more and 2.0 parts or less by mass thereof is preferably included based on 100 parts by mass of the total amount of the resin and the aforementioned various additives. Examples of the vulcanization accelerator include an accelerator based on sodium dithiocarbamate (for example, NOCCELER BZ (manufactured by OUCHI SHINKO CHEMICAL INDUSTRIAL CO., LTD.) composed mainly of zinc dibutyldithiocarbamate). For the aging inhibitor, 0.3 part or more and 0.7 part or less by mass thereof is preferably included based on 100 parts by mass of the total amount of the resin and the aforementioned various additives. Examples of the aging inhibitor include polynuclear phenols (for example, VULKANOX (registered trademark) BKF). The inorganic filler, the defoaming agent, the thickener, and the pigment each are added in an appropriate amount as needed. Various known inorganic fillers, defoaming agents, thickeners, and pigments can be used.

Next, a second coating liquid to form the second resin layers 13 and 23 covering the entire areas of the outer surfaces of the first resin layers 12 and 22 is applied to the entire areas of the outer surfaces of the first resin layers 12 and 22. The second coating liquid is applied to the entire areas of the outer surfaces of the first resin layers 12 and 22 by, for example, immersing the fiber glove with the first resin layers 12 and 22 formed thereon in the second coating liquid. After having the second coating liquid applied thereto, the fiber glove put on the hand form is dried at a certain temperature over a certain period of time by, for example, being placed in an oven for drying at 80° C. for 60 minutes, to form the second resin layers 13 and 23 on the entire areas of the outer surfaces of the first resin layers 12 and 22.

As the resin included in the second coating liquid, the same resin as that included in the first coating liquid can be used. Similar to the first coating liquid, the second coating liquid may include, in addition to the resin, a pH adjuster, a vulcanizing agent, a metal oxide, a vulcanization accelerator, an aging inhibitor, an inorganic filler, a defoaming agent, a thickener, a pigment, or the like.

Next, a third coating liquid to form the slip-suppressing layer 14 covering the entire area of the outer surface of the second resin layer 13 (i.e., the second resin layer of the glove body 10) is applied to the entire area of the outer surface of the second resin layer 13. The third coating liquid is applied to the entire area of the outer surface of the second resin layer 13 by, for example, immersing only the glove body 10 side of the fiber glove with the second resin layers 13 and 23 formed thereon in the third coating liquid. After having the third coating liquid applied thereto, the fiber glove put on the hand form is dried at a certain temperature over a certain period of time by, for example, being placed in an oven for drying at 80° C. for 60 minutes and then at 120° C. for 30 minutes, to form the slip-suppressing layer 14 on the entire area of the outer surface of the second resin layer 13.

The third coating liquid includes a resin and the cellulose particles 14*a*. As the resin included in the third coating liquid, the same resin as that included in the first coating liquid can be used. As the cellulose particles 14*a* included in the third coating liquid, any known cellulose particles as aforementioned can be used. The third coating liquid may include an additive (such as a plasticizer and the same various additives as those included in the first coating liquid) other than the cellulose particles 14*a*. In the case where the third coating liquid includes an additive other than the cellulose particles 14*a*, it preferably includes 18 parts or more and 56 parts or less by mass of the cellulose particles 14*a* based on 100 parts by mass of the total amount of the resin and the additive other than the cellulose particles 14*a*.

The glove 1 according to this embodiment can be obtained as described above.

The glove according to this embodiment is configured as above, and thus has the following advantageous effects.

A glove according to the present invention includes:

a glove body configured to cover a hand of a wearer, in which the glove body has an outermost layer that includes cellulose particles and constitutes an outer surface of the glove, and at least some of the cellulose particles are at least partially exposed from the outer surface.

Such a configuration allows the cellulose particles exposed from the outer surface to come into contact with the surface of an object, and thus allows the object to be relatively easily grasped even when such an object has a film of hydrophilic liquid formed on the surface.

In the aforementioned glove, it is preferable that the cellulose particles have an average particle size of 10 μm or more and 45 μm or less.

Since, according to such a configuration, the average particle size of the cellulose particles is 10 μm or more and 45 μm or less, an object can be more easily grasped even when such an object has a film of hydrophilic liquid formed on the surface.

In the aforementioned glove, it is preferable that the outermost layer include a resin and an additive other than the cellulose particles, and include 18 parts or more and 56 parts or less by mass of the cellulose particles based on 100 parts by mass of the total amount of the resin and the additive other than the cellulose particles.

Since, according to such a configuration, the outermost layer includes 18 parts or more and 56 parts or less by mass of the cellulose particles based on 100 parts by mass of the total amount of the resin and the additive other than the cellulose particles, an object can be still more easily grasped even when such an object has a surface on which a film of hydrophilic liquid is formed.

The glove according to the present invention is not limited to the aforementioned embodiment. The glove according to the present invention is not limited by the aforementioned operational advantages, either. Various modifications can be made for the glove according to the present invention without departing from the gist of the present invention.

The aforementioned embodiment has been described by taking, for example, the case where the glove body 10 has the four-layered structure while the cuff 20 has the three-layered structure (i.e., the glove body 10 has one fiber layer 11, two resin layers (the first resin layer 12 and the second resin layer 13), and one slip-suppressing layer 14 while the cuff 20 has one fiber layer 21 and two resin layers (the first resin layer 22 and the second resin layer 23)). However, the layered structures of the glove body 10 and the cuff 20 are not limited to the aforementioned embodiment. For example, the glove body 10 may have only one resin layer constituted by the first resin layer 12 to form the three-layered structure (i.e., one fiber layer 11, one resin layer, and one slip-suppressing layer 14), and the cuff 20 may have only one resin layer constituted by the first resin layer 22 to form the two-layered structure (i.e., one fiber layer 21 and one resin layer).

It should be noted that the glove body 10 formed to have two resin layers and one slip-suppressing layer on the outer surface of one fiber layer 11, that is, to have three resin-inclusive layers on the outer surface of one fiber layer 11 can improve its resistance to chemicals (such as acetic acid) and organic solvents. Specifically, the glove body 10 formed to have the three resin-inclusive layers has thick resin-inclusive layers, and the layered structure of the glove body 10 suppresses pinholes from being formed in the resin-inclusive layers; thus, the glove body 10 can improve its permeation resistance to chemicals and organic solvents. The glove including the glove body 10 formed to have the three resin-inclusive layers as described above can improve resistance to chemicals and organic solvents, and is thus suitable for food applications.

EXAMPLES

Hereinafter, the present invention will be more specifically described with reference to the examples. The following examples are provided for more specifically describing the present invention, and do not intend to limit the scope of the present invention.

Example 1

The glove according to Example 1 was produced using the following materials.

Fiber Layer

Three polyester two-ply yarns (each made of two 77 dtex polyester single yarns twisted together) were seamlessly knitted into a fiber layer using a glove knitting machine (model 13G N-SFG, manufactured by SHIMA SEIKI MFG., LTD.). The fiber layer was produced as a fiber glove including a glove body and a cuff.

First Resin Layer

The aforementioned fiber layer was put on a three-dimensional metal hand form, and the three-dimensional hand form was heated to 60° C.

Next, the fiber layer put on the heated three-dimensional hand form was immersed in a coagulant solution in which 3 parts by mass of calcium nitrate is dissolved in 100 parts by mass of methanol, to apply the coagulant solution to the entire area of the outer surface of the fiber layer. After the application of the coagulant solution, methanol was partially volatilized from the fiber layer.

Then, the fiber layer with the coagulant solution applied thereto was entirely immersed in a first coating liquid for forming a first resin layer, to apply the first coating liquid to the entire area of the outer surface of the fiber layer.

The fiber layer with the first coating liquid applied thereto was then dried in an oven at 80° C. for 60 minutes to form the first resin layer on the entire area of the outer surface of the fiber layer.

The first coating liquid was prepared by diluting the composition including the mixing materials shown in Table 1 with ion exchange water to have a solid content at a ratio of 36 mass %. The first coating liquid had a viscosity of 2000 m Pa·s (the value measured using a Brookfield viscometer under the condition of V6 (i.e., a rotational speed of 6 rpm, a temperature of 25° C.)). An observation of the cross section of the layers at a magnification of 100 times using a digital microscope (model VHX-6000, manufactured by KEYENCE CORPORATION) found that the first resin layer according to Example 1 was a non-porous layer.

TABLE 1

| Mixing material | Mixing ratio [mass parts of solid content] |
|---|---|
| NBR latex (Lx-550, manufactured by Zeon Corporation) | 100 |
| 10% KOH | 0.4 |
| Colloidal sulfur | 0.5 |
| Zinc oxide | 2.0 |
| Vulcanization accelerator (NOCCELER BZ, manufactured by OUCHI SHINKO CHEMICAL INDUSTRIAL CO., LTD.) | 0.2 |
| Aging inhibitor (VULKANOX (registered trademark) BKF) | 0.5 |
| Inorganic filler, defoaming agent, thickener, pigment | 5.0 |

*The mixing ratios are calculated assuming that the mixing materials are solid contents.

Second Resin Layer

After the first resin later was formed on the entire area of the outer surface of the fiber layer, the fiber layer with the first resin layer formed thereon was immersed in water to wash the surface of the first resin layer.

Next, the fiber layer with the first resin layer having the washed surface was dried in an oven at 80° C. for 10 minutes, and then the three-dimensional hand form was cooled to 60° C.

Thereafter, the fiber layer with the first resin layer formed thereon was entirely immersed in a second coating liquid for forming a second resin layer, to apply the second coating liquid to the entire area of the outer surface of the first resin layer.

Then, the fiber layer with the second coating liquid applied thereto was dried in an oven at 80° C. for 60 minutes to form the second resin layer on the entire area of the outer surface of the first resin layer.

The second coating liquid was prepared in the same manner as the first coating liquid. An observation of the cross section of the layers at a magnification of 100 times using a digital microscope (model VHX-6000, manufactured by KEYENCE CORPORATION) found that the second resin layer according to Example 1 was also a non-porous layer.

Slip-Suppressing Layer

After the second resin layer was formed on the entire area of the outer surface of the first resin layer, the three-dimensional hand form was cooled to 60° C.

Next, a portion of the fiber layer with the second resin layer formed thereon, which extends from the fingertip parts to an area near a wrist part, was immersed in a third coating liquid for forming a slip-suppressing layer, to apply the third coating liquid.

Thereafter, the fiber layer with the third coating liquid applied thereto was dried in an oven at 80° C. for 60 minutes, and then further dried in an oven at 120° C. for 30 minutes, to form the slip-suppressing layer on the entire area of the outer surface of the second resin layer of the glove body.

The glove according to Example 1 was thus obtained.

The third coating liquid was prepared by diluting the composition including the mixing materials shown in Table 2 with ion exchange water to have a solid content at a ratio of 15 mass %. The third coating liquid had a viscosity of 1000 m Pa·s (the value measured using a Brookfield viscometer under the condition of V6 (a rotational speed of 6 rpm, a temperature of 25° C.)).

As shown in Table 2 below, 27.6 parts by mass of the cellulose particles were added based on 100 parts by mass of the total amount of a resin (NBR latex) and additives other than the cellulose particles.

An observation of the cross section of the slip-suppressing layer at a magnification of 300 times using a digital microscope (model VHX-6000, manufactured by KEYENCE CORPORATION) found that at least some of the cellulose particles were partially exposed from the outer surface of the slip-suppressing layer, as shown in FIG. 3B.

TABLE 2

| Mixing material | Mixing ratio [mass parts of solid content] | No. of parts by mass of cellulose particles based on 100 parts by mass of resin and additives other than cellulose particles |
|---|---|---|
| NBR latex (Lx-550, manufactured by Zeon Corporation) | 100 | |
| 10% KOH | 0.4 | |

TABLE 2-continued

| Mixing material | Mixing ratio [mass parts of solid content] | No. of parts by mass of cellulose particles based on 100 parts by mass of resin and additives other than cellulose particles |
|---|---|---|
| Colloidal sulfur | 0.5 | |
| Zinc oxide | 2.0 | |
| Vulcanization accelerator (NOCCELER BZ, manufactured by OUCHI SHINKO CHEMICAL INDUSTRIAL CO., LTD.) | 0.2 | |
| Aging inhibitor (VULKANOX (registered trademark) BKF) | 0.5 | |
| Inorganic filler, defoaming agent, thickener, pigment | 5.0 | |
| Cellulose particles (KC FLOCK (registered trademark) W-100GK) | 30 | 27.6 |

*The mixing ratios are calculated assuming that the mixing materials are solid contents.

The average particle size of the cellulose particles included in the slip-suppressing layer was 37 μm, according to the measurement thereof before mixing, using a laser diffraction-type particle-size-distribution measuring apparatus (Mastersizer 2000 manufactured by Malvern Panalytical Ltd). The average particle size of the cellulose particles was measured as follows. That is, the dedicated software called Mastersizer 2000 Software was used, the scattering type measurement mode was employed, and a wet cell through which dispersion liquid with the cellulose particles dispersed therein is circulated was irradiated with a laser beam, to obtain a scattered light distribution from the cellulose particles. Then, the scattered light distribution was approximated according to a log-normal distribution, and a particle size corresponding to the cumulative frequency of 50% (D50) within the preset range from the minimum value of 0.021 μm to the maximum value of 2000 μm in the obtained particle size distribution (horizontal axis, σ) was determined as the average particle size. In the measurement, the dispersion liquid for use was prepared by adding 60 mL of 0.5 mass % hexametaphosphoric acid solution to 350 mL of purified water. The concentration of the cellulose particles in the dispersion liquid was 10%. Before the measurement, the dispersion liquid including the cellulose particles was treated for two minutes using an ultrasonic homogenizer. Further, the measurement was performed while the dispersion liquid including the cellulose particles was agitated at an agitating speed of 1500 rpm.

The ratio of the length L to the width D of the cellulose particles, that is, the ratio L/D of the cellulose particles, was 6.3, according to the measurement thereof before mixing. The L and D of the cellulose particles were measured in the manner as aforementioned.

Example 2

The glove according to Example 2 was produced in the same manner as Example 1, except that 9.2 parts by mass of the cellulose particles having an average particle size of 10 μm based on 100 parts by mass of the total amount of the resin and the additives other than the cellulose particles were added to the third coating liquid.

The ratio L/D of the cellulose particles was 4.3.

Example 3

The glove according to Example 3 was produced in the same manner as Example 1, except that 18.4 parts by mass of the cellulose particles having an average particle size of 10 μm based on 100 parts by mass of the total amount of the resin and the additives other than the cellulose particles were added to the third coating liquid.

The ratio L/D of the cellulose particles was 4.3.

Example 4

The glove according to Example 4 was produced in the same manner as Example 1, except that 55.2 parts by mass of the cellulose particles having an average particle size of 10 μm based on 100 parts by mass of the total amount of the resin and the additives other than the cellulose particles were added to the third coating liquid.

The ratio L/D of the cellulose particles was 4.3.

Example 5

The glove according to Example 5 was produced in the same manner as Example 1, except that 18.4 parts by mass of the cellulose particles having an average particle size of 24 μm based on 100 parts by mass of the total amount of the resin and the additives other than the cellulose particles were added to the third coating liquid.

The ratio L/D of the cellulose particles was 3.8.

Example 6

The glove according to Example 6 was produced in the same manner as Example 1, except that 27.6 parts by mass of the cellulose particles having an average particle size of 24 μm based on 100 parts by mass of the total amount of the resin and the additives other than the cellulose particles were added to the third coating liquid.

The ratio L/D of the cellulose particles was 3.8.

Example 7

The glove according to Example 7 was produced in the same manner as Example 1, except that 55.2 parts by mass of the cellulose particles having an average particle size of 24 μm based on 100 parts by mass of the total amount of the resin and the additives other than the cellulose particles were added to the third coating liquid.

The ratio L/D of the cellulose particles was 3.8.

Example 8

The glove according to Example 8 was produced in the same manner as Example 1, except that 55.2 parts by mass of the cellulose particles based on 100 parts by mass of the total amount of the resin and the additives other than the cellulose particles were added to the third coating liquid.

The ratio L/D of the cellulose particles was 6.3.

Example 9

The glove according to Example 9 was produced in the same manner as Example 1, except that 18.4 parts by mass of the cellulose particles having an average particle size of 45 μm based on 100 parts by mass of the total amount of the resin and the additives other than the cellulose particle were added to the third coating liquid.

The ratio L/D of the cellulose particles was 5.8.

Example 10

The glove according to Example 10 was produced in the same manner as Example 1, except that 27.6 parts by mass of the cellulose particles having an average particle size of 45 μm based on 100 parts by mass of the total amount of the resin and the additives other than the cellulose particles were added to the third coating liquid.

The ratio L/D of the cellulose particles was 5.8.

Example 11

The glove according to Example 11 was produced in the same manner as Example 1, except that 55.2 parts by mass of the cellulose particles having an average particle size of 45 μm based on 100 parts by mass of the total amount of the resin and the additives other than the cellulose particles were added to the third coating liquid.

The ratio L/D of the cellulose particles was 5.8.

Comparative Example 1

The glove according to Comparative Example 1 was produced in the same manner as Example 1, except that the type of slip-suppressing particles included in the third coating liquid was a composite (having an average particle size of 100 μm) of nitrile butadiene rubber particles (NBR particles) and acrylic rubber particles (AR particles), and that 38 parts by mass of such particles were added. The average particle size of the composite was measured in the same manner as in the case of cellulose particles.

For the gloves according to Examples and Comparative Example, the types of slip-suppressing particles included in the third coating liquid, the average particle sizes of the slip-suppressing particles, and the numbers of parts by mass of the slip-suppressing particles added are shown in Table 3 below. The occupancy ratios of the projections on the outer surface of the slip-suppressing layer were determined using a digital microscope (model VHX-6000, manufactured by KEYENCE CORPORATION). The results are also shown in Table 3. The occupancy ratios of the projections were measured in the aforementioned manner.

TABLE 3

| | EX. 1 | EX. 2 | EX. 3 | EX. 4 | EX. 5 | EX. 6 |
|---|---|---|---|---|---|---|
| Type of slip-suppressing particles | Cellulose particles | Cellulose particles | Cellulose particles | Cellulose particles | Cellulose particles | Cellulose particles |
| Ave. particle size [μm] | 37 | 10 | 10 | 10 | 24 | 24 |
| No. of parts by mass added [parts by mass] | 27.6 | 9.2 | 18.4 | 55.2 | 18.4 | 27.6 |
| Occupancy ratio of projections [%] | 49.6 | 13.7 | — | 33.0 | — | — |
| Grippability evaluation | 2.4 | 0.2 | 0.5 | 1.0 | 1.6 | 1.7 |
| Abrasion loss after 50 times abrasion [mg] | 9 | — | — | — | — | — |
| Abrasion loss after 100 times abrasion [mg] | 12.7 | — | — | — | — | — |

| | EX. 7 | EX. 8 | EX. 9 | EX. 10 | EX. 11 | C. EX. 1 |
|---|---|---|---|---|---|---|
| Type of slip-suppressing particles | Cellulose particles | Cellulose particles | Cellulose particles | Cellulose particles | Cellulose particles | NBR particles + AR particles |
| Ave. particle size [μm] | 24 | 37 | 45 | 45 | 45 | 100 |
| No. of parts by mass added [parts by mass] | 55.2 | 55.2 | 18.4 | 27.6 | 55.2 | 38.0 |
| Occupancy ratio of projections [%] | — | 53.0 | 40.1 | 46.5 | — | — |
| Grippability evaluation | 1.7 | 2.9 | 1.4 | 2.3 | 2.9 | 0 |
| Abrasion loss after 50 times abrasion [mg] | 12.5 | 13.1 | — | — | 17.9 | 19.0 |
| Abrasion loss after 100 times abrasion [mg] | 16.7 | 17.1 | — | — | 25.0 | 27.3 |

Gripp Ability Evaluation

The gloves according to Examples 1 to 10 and the glove according to Comparative Example 1 were evaluated for their grippability when ice was grasped, the results of which are shown in Table 3. The gripp ability was evaluated by sensory evaluation. Specifically, the evaluation was performed by 14 test subjects who wore the gloves according to Examples and Comparative Example, grasped a cylindrically-shaped ice having a diameter of about 9 cm and a height of about 9 cm, and evaluated the grippability according to three grades, followed by dividing the total points by the number of the test subjects. The three grades include 0 point, 1 point, and 3 points, each grade indicating as follows. 0 point: Not capable of grasping ice. 1 point: Capable of grasping ice but not stably. 3 points: Capable of firmly grasping ice.

Table 3 reveals that the gloves according to Examples, that is, the gloves having the cellulose particles included in the slip-suppressing layer exhibit gripp ability on ice while the glove according to Comparative Example 1, that is, the glove having the composite of the NBR particles and the AR particles included in the slip-suppressing layer does not exhibit grippability on ice. The grippability evaluation results of Example 1 and Example 8, the grippability evaluation results of Examples 2 to 4, the gripp ability evaluation results of Examples 5 to 7, and the gripp ability evaluation results of Example 9 and Example 11 reveal that, when the Examples share the same average particle size of the cellulose particles included in the respective slip-suppressing layers, the larger the number of parts by mass of the cellulose particles added becomes, the higher the grippability tends to be.

Further, the grippability evaluation results of Examples 1, 6, and 10, the grippability evaluation results of Examples 3, 5, and 9, and the grippability evaluation results of Examples 4, 7, 8, and 11 reveal that, when the Examples share the same number of parts by mass of the cellulose particles included in the respective slip-suppressing layers, the larger the average particle size of the cellulose particles becomes, the higher the grippability tends to be.

A comparison of the occupancy ratios of the projections between Examples 1 and 8, between Examples 2 and 4, and between Examples 9 and 10 reveal that, when the Examples share the same average particle size of the cellulose particles included in the respective slip-suppressing layers, the larger the number of parts by mass of the cellulose particles added becomes, the higher the occupancy ratio of the projections tends to be, and the higher the occupancy ratio of the projections becomes, the higher the grippability tends to be.

It was further found that the grippability is sufficiently delivered when the occupancy ratio of the projections is 10% or more and 60% or less, the grippability is more sufficiently delivered when the occupancy ratio of the projections is 30% or more and 60% or less, and the grippability is further sufficiently delivered when the occupancy ratio of the projections is 35% or more and 60% or less.

Evaluation of Abrasion Loss of Slip-Suppressing Particles

A certain test piece was cut out of the palm of each of the gloves according to Examples 1, 7, 8, and 11 and the glove according to Comparative Example 1, to measure abrasion loss after 50 times abrasion and 100 times abrasion according to the European Standard EN 388:2003, using the Nu-Martindale tester specified in EN ISO 12947-1. The abrasion loss was evaluated by observation of a change in the weight of the test piece before and after abrasion. The results are shown in Table 3.

A comparison between the abrasion loss of the cellulose particles in Examples 1, 7, 8, and 11 and the abrasion loss of the composite of the NBR particles and the AR particles in Comparative Example 1 reveals that the composite of the NBR particles and the AR particles has larger abrasion loss than that of the cellulose particles both in 50 times abrasion and 100 times abrasion.

A comparison between the abrasion loss of the cellulose particles in Example 1 and the abrasion loss of the cellulose particles in Example 8 reveals that, when the Examples share the same average particle size of the cellulose particles, the smaller the number of parts by mass of the cellulose particles added is, the smaller the abrasion loss becomes after both 50 times abrasion and 100 times abrasion.

A comparison among the abrasion loss of the cellulose particles in Example 7, the abrasion loss of the cellulose particles in Example 8, and the abrasion loss of the cellulose particles in Example 11 reveals that, when the Examples share the same number of parts by mass of the cellulose particles added, the larger the average particle size of the cellulose particles is, the larger the abrasion loss becomes.

Since, as described above, the cellulose particles used as the slip-suppressing particles relatively reduce the abrasion loss of the slip-suppressing particles, the glove having the cellulose particles as the slip-suppressing particles can relatively reduce incorporation of foreign matter to food when such a glove is used for food applications. Thus, the glove having the cellulose particles as the slip-suppressing particles is suitable for food applications.

REFERENCE SIGNS LIST

1: Glove
10: Glove body
11: Fiber layer
12: First resin layer
13: Second resin layer
14: Slip-suppressing layer
20: Cuff
21: Fiber layer
22: First resin layer
23: Second resin layer
14*a*: Cellulose particles
14A: Projection
14B: Recess

The invention claimed is:

1. A glove comprising:

a glove body configured to cover a hand of a wearer; and a cuff continuous with the glove body, wherein the glove body comprises a fiber layer; a resin layer covering an outer surface of the fiber layer; and an outermost layer including cellulose particles and arranged to cover an outer surface of the resin layer of the glove body to constitute an outer surface of the glove, the cellulose particles have an average particle size of 24 μm or more and 45 μm or less, the outermost layer of the glove body further comprises a resin and an additive other than the cellulose particles, and includes 18 parts or more and 56 parts or less by mass of the cellulose particles based on 100 parts by mass of the total amount of the resin and the additive other than the cellulose particles, the cellulose particles comprise fibrous particles having D of 3 μm or more and 20 μm or less and a ratio L/D of 2.0 or more and 6.3 or less, where D represents a width of each of the fibrous particles and L represents a length of each of the fibrous particles, at least some of the cellulose particles are at least partially exposed from the outer surface of the glove, the cuff comprises a fiber layer and at least one resin layer covering an outer surface of the fiber layer of the cuff, a material of an outermost layer of the cuff is different from a material of the outermost layer of the glove body, the outermost layer of the cuff does not contain any cellulose particles, and the outermost layer of the glove body has a thickness of 0.01 mm or more and 0.07 mm or less.

2. The glove according to claim 1, wherein the outermost layer of the glove body comprises projections each formed by the cellulose particles that gather in the outermost layer of the glove body and rise outward from the outer surface of the outermost layer of the glove body, and an occupancy ratio of the projections on the outer surface of the outermost layer of the glove body is 30% or more and 60% or less.

3. The glove according to claim 1, wherein the resin layer of the glove body comprises a non-porous resin layer.

4. The glove according to claim 1, wherein the outermost layer of the glove body comprises projections each formed by the cellulose particles that gather in the outermost layer of the glove body and rise outward from the outer surface of the outermost layer of the glove body, the projections are randomly arranged on the outer surface of the outermost layer, and an occupancy ratio of the projections on the outer surface of the outermost layer of the glove body is 30% or more and 60% or less.

* * * * *